United States Patent [19]

Alsenz et al.

[11] Patent Number: 4,535,602

[45] Date of Patent: Aug. 20, 1985

[54] SHIFT LOGIC CONTROL APPARATUS FOR UNEQUAL CAPACITY COMPRESSORS IN A REFRIGERATION SYSTEM

[75] Inventors: Richard H. Alsenz, 4730 Creek Meadow, Missouri City, Tex. 77459; Roger C. Ansted, Houston, Tex.

[73] Assignee: Richard H. Alsenz, Missouri City, Tex.

[21] Appl. No.: 541,278

[22] Filed: Oct. 12, 1983

[51] Int. Cl.[3] ..... F25B 7/00

[52] U.S. Cl. ..... 62/175; 62/228.3; 236/1 EA

[58] Field of Search ..... 62/175, 228.5, 228.3, 62/158; 236/1 EA; 307/39, 141

[56] References Cited

U.S. PATENT DOCUMENTS

| | | | |
|---|---|---|---|
| 3,513,662 | 5/1970 | Golber | 62/175 |
| 3,844,475 | 10/1974 | Kesterson et al. | 165/26 X |
| 4,081,691 | 3/1978 | Evalds et al. | 236/1 EA |
| 4,384,462 | 5/1983 | Overman et al. | 62/175 |

*Primary Examiner*—William E. Wayner

*Attorney, Agent, or Firm*—Arnold, White & Durkee

[57] ABSTRACT

Apparatus for capacity selecting compressor energization and deenergization in a commonly piped, multiple compressor system comprising largely compressor of unequal capacity wherein the minimum number of such compressors are cycled on/off together and wherein equal capacity compressors in the system are alternately selected to even the wear therebetween.

6 Claims, 2 Drawing Figures

SHIFT LOGIC CONTROL APPARATUS FOR UNEQUAL CAPACITY COMPRESSORS IN A REFRIGERATION SYSTEM

BACKGROUND OF THE INVENTION

1. Field of the Invention

This invention relates to a cooling or refrigeration system comprising a plurality of individual compressors and more specifically to operating such a system comprising a plurality of compressors of unequal capacity in such a manner so as to selectively energize the individual compressors to efficiently match the load while avoiding stressful cycling of the compressors.

2. Background of the Invention

Cooling systems generally comprise a condensor coil, a receiving vessel for the condensed liquid from the condensor coil, an expansion valve, an evaporator coil and a compressor connected to the condensor coil. Improvements over the simplest form of cooling system just described have included multiple compressors, rather than only one, and alternating or selecting their use in accordance with demand so as to use only enough compressor capacity sufficient for demand and so as to minimize wear on the compressors and compressor contactors.

It is also known that there are advantages to operate a multiple compressor system wherein the compressors are commonly piped. Further, it is known that it is sometimes advantageous to operate a system of commonly-piped multiple compressors of unequal capacity. By selecting between the compressors using a logic circuit it is possible to selectively match demand from a range of compressor operation wherein only the smallest capacity compressor is energized to compressor operation wherein all of the available compressors are utilized. By applying binary logic to program the capacity selection device, it is possible to select all of the available incremental combinations available as represented by the individual compressors. In addition, there are other procedural programming schemes available for incrementally selecting the compressors.

It is known that it is stressful on the compressors in the system when many of them are cycling or changing state of energization at the same time. That is, surges and excessive wear of compressors and contactors are caused by cycling together three or four compressors of a 4-compressor system. Cycling only one or two compressors at a time does not cause the same degree of wear.

It is also common in a multiple compressor system where most of the compressors are of unequal capacity to have two of the same capacity, or, in the system where there are a large number of unequal capacity compressors, to have a few duplications of capacity included. It is stressful to cycle the same compressors on and off compared with another of the same capacity if every time that capacity-sized compressor is programmed for logic selection.

Therefore, it is a feature of the present invention to provide for an improved selection of the individual compressors in a commonly-piped, multiple compressor system employing largely unequal capacity compressors wherein no more than a minimum number of compressors are cycled through a change of state energization at the same time.

It is another feature of the present invention to provide for an improved selection of the individual compressors in a commonly-piped, multiple compressor system employing largely unequal capacity compressor, but where there is also at least one duplication of capacity among the compressors, so as to provide for a minimum number of simultaneous change-of-state energizations while also equalizing the cycling among the compressors of the same capacity.

SUMMARY OF THE INVENTION

The invention herein disclosed pertains to apparatus for controlling compressor energization in a commonly-piped, multiple compressor system primarily comprised of unequal capacity compressors. Compressor selection is chosen to match load demand. However, in contrast to prior art schemes, as the demand is increased or decreased, only a minimum number of compressors, preferably half or less of the number of compressors connected for selection, are cycled through a change of energization state at the same time. Further, in the case where the system also includes a duplication of capacity logic circuit so as to equalize, as nearly as possible, the times that these compressors are cycled on/off with respect to each other.

It will be apparent that not all of the combinations of compressors will be chosen with such a scheme; however, most of the combinations will be chosen and the wear on the compressors and contactors will be greatly reduced.

BRIEF DESCRIPTION OF THE DRAWINGS

So that the manner in which the above-recited features, advantages and objects of the invention, as well as others which will become apparent are attained and can be understood in detail, more particular description of the invention briefly summarized above may be had by reference to the embodiment thereof which is illustrated in the drawings, which drawings form a part of this specification. It is to be noted, however, that the appended drawings illustrate only a preferred embodiment of the invention and are therefore not to be considered limiting of its scope, for the invention may admit to other equally effective embodiments.

In the drawings.

DESCRIPTION OF THE PREFERRED EMBODIMENTS

Figure 1:
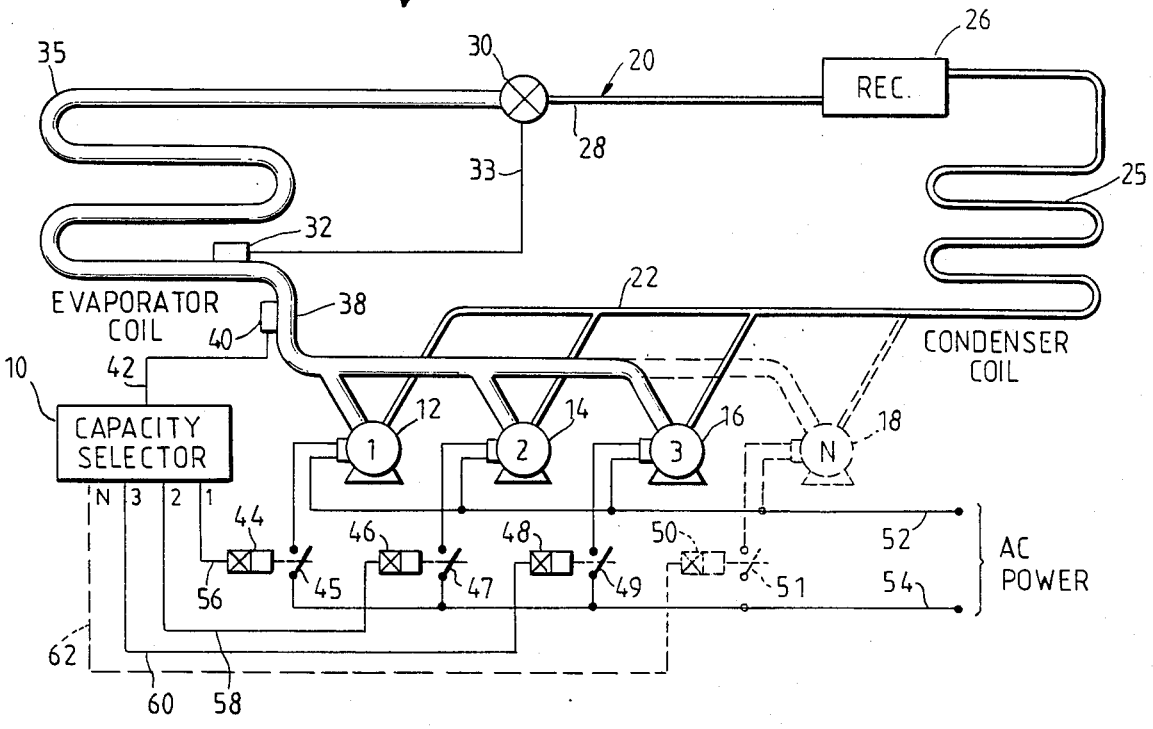
FIG. 1 is a simplified mechanical/electrical block and schematic diagram of a cooling system employing capacity selection apparatus in accordance with the present invention.

Now referring to the drawings, and first to FIG. 1, the capacity selection means 10 for choosing the compressors to be energized and deenergized in accordance with the present invention is shown in a multiple-stage refrigeration or cooling system 20. System 20 comprises a plurality of parallel-staged refrigerant compressors 12, 14, 16 and 18 for discharging compressed pressurized refrigerant vapor through discharge line 22 to a condensor coil 25 where the pressurized refrigerant vapor is condensed to a liquid and then delivered to a receiver vessel 26. From the receiver 26, the liquid refrigerant flows through line 28 and through an expansion device or valve 30, typically an expansion valve responding to the temperature in suction line 38 as sensed by temperature sensing device 32. The temperature signal from sensor 32 is applied to valve 30 through conductor 33 to initiate the expansion valve action. The liquid refrigerant is injected through expansion device 30 into the evaporator coil 25 where the liquid refrigerant, encountering the low pressure of the evaporator coil, boils and evaporates, thus absorbing heat from the evaporator coil. The hot vaporized refrigerant from the vapor coil is drawn through suction line 38 to the inlet ports of the multiple compressors 12–18. The number of parallel compressors to be staged in the system varies according to the refrigerating or cooling system load. In FIG. 1, three compressors are shown in dotted lines as 12, 14 and 16 and an "N"th number of compressors is shown by compressor 18.

A pressure transducer 40 is attached to suction line 38 and determines the refrigerant vapor pressure within the suction line and generates an electrical signal representative of the measured pressure. The signal is applied through conductor 42 as an input to capacity selector 10, which will be hereinafter described in greater detail. The output of the capacity selector 10 is a plurality of outputs corresponding to the number of the plurality of cooling stages or parallel compressors staged in the system. Accordingly, there are a corresponding "N" number of outputs from the capacity selector 10 labelled 1, 2, 3 and N. The selector output 1 is applied through conductor 56 to the coil of a relay 44 which controls relay switch contacts 45 for applying AC power via conductors 52 and 54 to the first compressor 12 for energizing the compressor when it is desired to cut the compressor into the system. Similarly, the 2, 3 and N outputs of the capacity selector are applied through conductors 58, 60 and 62, respectively, to the coils of relays 46, 48 and 50, respectively, for successively applying AC electrical power to the 2, 3 and N compressors, respectively, for either turning on or turning off the compressors in a stage sequence.

Figure 2:
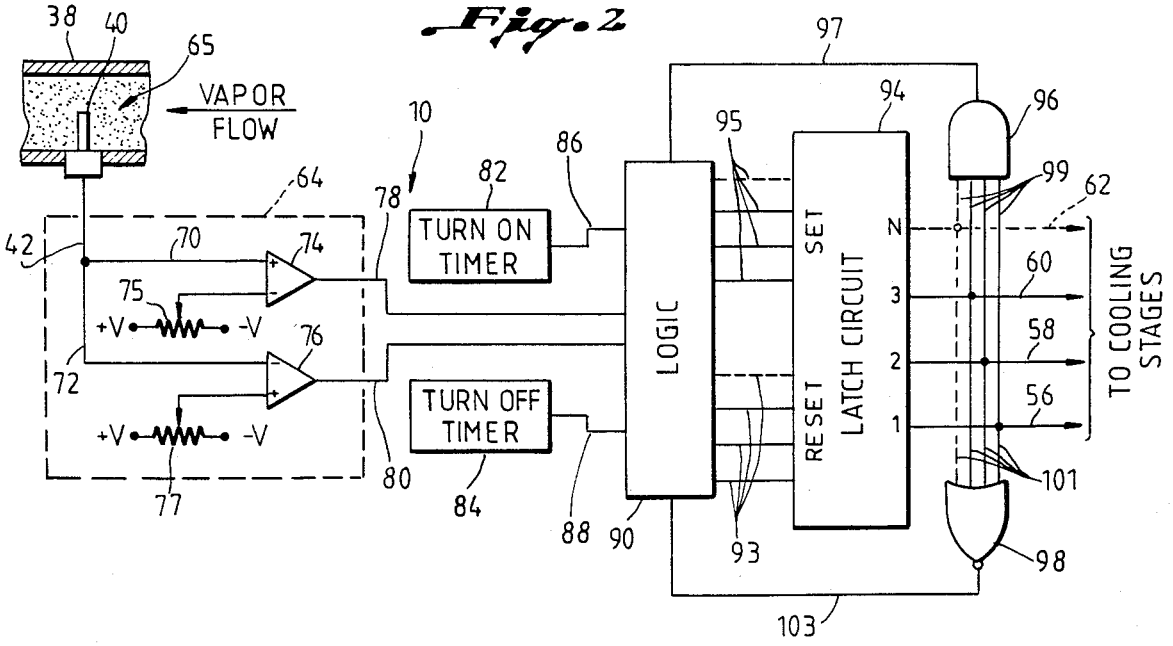
FIG. 2 is a block diagram of the capacity selector portion of the apparatus shown in FIG. 1.

Referring now to FIGS. 1 and 2 the operation of the capacity selector 10 will be described in greater detail. The pressure detecting means for transducer 40 is shown sealingly inserted into the refrigerant vapor flow 65 in suction line tubing 38. Pressure transducer 40 may be any conventional pressure detecting means for generating an electrical signal representative of the pressure within line 38. The pressure signal from transducer 40 is applied through conductors 42 and 70 to the positive input of a comparator circuit 74, and through conductors 42 and 72 to the negative input of a second comparator circuit 76. To set a predetermined "cut-in" pressure for the system, a voltage potential is applied through a voltage varying means such as a potentiometer 75 to the negative input of the comparator circuit 74. Similarly, a voltage is applied through a voltage varying means such as potentiometer 77 to the positive input of the comparator circuit 76 to set a predetermined "cut-out" pressure for the system. Comparator circuit 74 compares the predetermined cooling system "cut-in" pressure (set by potentiometer 75) against the suction line pressure continuously detected by pressure transducer 40 and produces a "cut-in" electrical signal when the pressure exceeds the predetermined "cut-in" pressure. Comparator circuit 76 compares the predetermined cooling system "cut-out" pressure (set by potentiometer 77) against the pressure continuously detected by the pressure transducer 40 and produces a "cut-out" electrical signal when the detected system pressure exceeds the predetermined "cut-out" pressure. The combination of transducer 40, potentiometers 75 and 77 for establishing system pressure "cut-in" or "cut-out" pressure levels and comparators 74 and 76 also comprise detection means 64 for establishing a selected cooling stage "cut-in" or "cut-out" pressure and determining when those established pressure have been reached and providing an output signal in response thereto, i.e., output of comparators 74 or 76.

The "cut-in" signal of comparator 74 is applied through conductor 78 to logic device 90, which generates an output electrical control signal as further determined by an appropriate input on conductor 86 from turn on timer 82, as explained more fully hereinafter. The output from timer 82 is referred to sometimes hereafter as a delay control signal. Logic device 90 generates a successive plurality of outputs 1 to N corresponding to the number of staged parallel compressors in the system. Each delayed "turn on" control signal received from timer 82 by logic device 90 causes an output signal to appear at one of the of outputs 1, 2, 3 or N in a manner explained hereinafter, which is applied via conductor 95 as a "set" input to a latch circuit 94.

Latch circuit 94 is of conventional solid-state design and generates a series of repeatable successive "cut-in" electrical control signals at outputs 1, 2, 3 and N, to be applied through conductors 56, 58, 60 and 62, respectively, to a series of repeatable successive compressor control relays 44, 46 and 48 and 50, respectively, in response to successive "set" input signals received via conductors 95 from the 1, 2, 3 and N outputs of logic device 90. For example, if logic device 90 has an output signal at output 1 applied through a conductor 95 as a "set" input to latch circuit 94, latch circuit 94 will generate a control signal output voltage at its 1 output (conductor 56). Similarly, output signals from logic device 90 appearing in a series successively at output 2, 3 and N are applied through conductors 95 as repeatable successive "set" inputs to latch circuit 94, thereby generating "cut-in" or turn on control signals appearing at outputs 2, 3 and N (conductors 58, 60 and 62, respectively). The electrical control signals are voltages applied through conductors 56, 58, 60 and 62, respectively, to relays 44, 46, 48 and 50, respectively as hereinabove described for respectively energizing the relays 44, 46 48 and 50, in turn, turning on or energizing one of multiple compressors 12, 14, 16 and 18, respectively. As will be explained more fully below, compressors 12, 14, 16 and 18 are generally of unequal capacity although there may be some duplication of capacity among the individual compressors.

Similarly, the "cut-out" output signal of comparator 76 is applied through conductor 80 to logic device 90, which generates an output electrical control signal as further determined by an appropriate input on conductor 88 from turn off timer 84, as explained more fully hereinafter. This output from timer 84 is also referred to as a delay control signal. The delay control signal is applied through conductor 88 as another input to logic device 90. Each successive delay "turn off" control signal received from timer circuit 84 generates one of a series of repeatable successive electrical signals at outputs 1, 2, 3 and N of logic device 90 which are applied through conductors 93 as "reset" inputs to latch circuit 94. Receipt of the successive series of delay "turn off" control signals from logic device 90 causes latch circuit 94 to be reset in the manner in which such signals are received.

For example, upon receipt of a logic device 90 output 1 signal applied through conductor 93 as a "reset" input to latch circuit 94, the latch 94 output at 1 will be reset and no voltage will appear on conductor 56, thus de-energizing relay 44, opening relay switch contacts 45 and "cutting-out" first compressor 12. In similar fashion, signals received from outputs 2, 3 and N as "reset" inputs to latch circuit 94 respectively reset the latch circuit and removes the latch circuit voltage outputs appearing at lines 2, 3 and N (conductors 58, 60 and 62, respectively), for respectively "cutting-out" compressors 14, 16 and 18.

In addition, the latch circuit outputs 1, 2, 3 and N (conductors 56, 58, 60 and 62, respectively) are also connected by conductors 99 as inputs to a conventional AND gate 96. When all of the latch circuit outputs 1, 2, 3 and N have positive output voltages appearing thereon, the AND gate 96 generates an output signal applied through conductor 97 to logic device 90 to disable logic device 90 to prevent further delay "turn on" electrical signals received from timer 82 from generating further output electrical signals for application to latch circuit 94. Similarly, the latch circuit outputs 1, 2, 3, and N are also connected by means of conductors 101 as inputs to a conventional NOR gate 98. NOR gate 98 will generate an electrical output signal to be applied through conductor 103 to disable logic device 90 when all of the latch circuit outputs 1, 2, 3 and N have been reset and there are no output voltage signals present thereon. The electrical signal received from NOR gate 98 disables logic device 90 to prevent any further control "turn off" delay signals received from timer 84 from triggering any further output signals to be applied as reset inputs to latch circuit 94.

The operation of turn on timer 82 to produce a control "turn on" delay signal is in conjunction with sensing the turning on of any one of the compressors. The production of a "cut-in" signal on line 78 in the manner previously discussed will result in the turning on of a compressor. At the same time, a signal is fed back through the logic circuit to turn on timer 82, which produces a disenabling signal for a timed delay period. Another "cut-in" signal on conductor 78 before the timed delay period has elapsed will not result in an output on lines 95 until such period has elapsed and the disenabling signal is removed.

In similar fashion, the operation of turn off timer 84 to produce a control "turn off" delay signal is in conjunction with sensing the turning off of any one of the compressors. The production of a "cut-off" signal on line 80 in the manner previously discussed will result in the turning off of a compressor. At the same time, a signal is fed back through the logic circuit to turn on timer 84, which produces a disenabling signal for a timed delay period. Another "cut-out" signal on conductor 80 before the time delay period has elapsed will not result in an output on lines 93 until such period has elapsed and the disenabling signal is removed.

Alternatively to the block diagram arrangement shown in FIG. 2, AND gate 96 and NOR gate 98 can be included in the logic device 90 with the other logic components, rather than be discrete circuit components, if desired.

The operation of the capacity controlling circuit can now further be described with reference to FIGS. 1 and 2. In the most simple version of the invention, the capacity controlling circuit operates in conjunction with a pre-selected "cut-in" pressure, as set by potentiometer 75 connected to comparator 74, and a preselected lower "cut-out" pressure, as set by potentiometer 77 connected to comparator 76, as hereinabove described. The desired system suction pressure range between these two pressure settings is selected for optimum system efficiency. The time period established by timer 82 is usually a longer period of time than established by timer 84. Assuming that compressors 1 and 2 are operating in the system within the desired pressure range and the refrigerator load increases the suction line pressure will rise and, if the load is heavy enough, the pressure will rise until it exceeds the predetermined value established by potentiometer 75. When this occurs, then comparator 74 generates an electrical "cut-in" signal as explained above. This will have the effect of selecting an additional compressor for operation. As also explained, this also activates turn on timer 82.

The suction pressure may continue to rise, or a at least stay above the "cut-in" pressure level even though an additional compressor has been added. Therefore, after the elapse of the delay period caused by timer 82, logic device 90 will generate an output signal at, for example, output 3 which is then applied through a conductor 95 as a "set" input to latch circuit 94. As more fully explained below, logic device 90 does not necessarily generate outputs in successive order and does on frequent occasion, simultaneously generate a "set" input to latch circuit 94 which also generating a "reset" input for ultimately changing the energization state of a different compressor.

Receipt of the delay "turn on" control signal from timer 82 by the latch circuit 94 causes a positive voltage to appear at latch output 3 (conductor 60) which is applied to relay 48 for energizing the relay, closings relay switch 48 for energizing the relay, closings relay switch 49 and "cutting-in" the third compressor 16. If pressure operation is back within range, then no further compressors will be switched into the system.

In the event the suction pressure declines because of over-capacity in the system, and falls below the predetermined "cut-out" pressure, then comparator 76 will generate a "cut-out" signal as explained above. If there is no disenabling delay turn-off control signal 88 from the turn off timer 84, then a "cut-out" electrical signal is produced from logic device 90, for example, on line 1 applied through a conductor 93 to latch circuit 94 as a "reset" input. The reset signal applied to latch circuit 94 will "reset" output line 1 of the latch circuit, thereby removing the positive voltage output at conductor 56 and de-energizing relay 44, opening switch contacts 45 and "cutting-out" compressor 12 from the system. When compressor 12 is "cut-out" of the system, the suction line pressure begins to increase until it returns to the desired operating range between the pressure differentials previously discussed.

In this way the multiple staged compressors can be "cut-in" or "cut-out" of the system to increase or decrease refrigeration capacity depending on the system refrigeration load.

Operation just discussed can conveniently be with mere sensing of "cut-in" and "cut-out" pressure levels and the related operation of timers 82 and 84, as well as the compressors in the system. Of course, the time periods for timers 82 and 84 may be established for different lengths of time. Timer 82 is typically established for a five-minute period and timer 84 is typically established for a five-second period, but these time periods can be changed greatly. Furthermore, the voltages on potentiometers 75 and 77 carry quantitative information of the amount of pressure range deviation from the desirable range that is occurring at any given time. Hence, this information can be fed to the respective timers for selecting the time periods, rather than having the timers operate respectively in conjunction with only one predetermined time-period value. The time-period values can be selected from a set of step values or from an analog time period range, as desired. In either event, by changing the periods of the delay control signals, switching of the compressors in and/or out of the system can be speeded up when the common suction pressure is far from the desirable range, not just a little outside of the limits.

The refrigeration capacity control invention herein disclosed may be utilized in controlling multiple-stage refrigeration or cooling systems having multi-cylinder compressors that are staged by controlling the compression of a plurality of compressor cylinders using conventional control valves by having controller 10 outputs control the utilization of the cooling stages by controlling the cylinders used by the compressors in the system. In addition, it is important to understand that while the system above described in FIGS. 1 and 2 uses two timers, it is possible to use only a single timer. If the timer has the ability to operate in conjunction with selectable time periods as discussed above, then such timer would operate in conjunction with the absolute value of either an applied "cut-in" signal or an applied "cut-out" signal.

It has been observed that one manner of sequencing the energization of unequal capacity energization of unequal capacity compressors is to use binary logic for logic device 90. In the table below, it is assumed that four compressors are employed, wherein compressor #1 has a 5 hp capacity, compressor #2 has a 10 hp capacity, compressor #3 has a 20 hp capacity and compressor #4 has a 40 hp capacity. With such a combination and using binary logic, it is possible to progress from 5 hp to 75 hp total capacity in 15 steps, each step representing a 5 hp increment. Please note that in Table 1 an underline is used to show that an individual compressor has changed energization state in progressing in the increasing capacity direction.

TABLE 1

| | BINARY LOGIC - 4 COMPRESSORS OF UNEQUAL CAPACITY | | | | | |
|---|---|---|---|---|---|---|
| Step | #1 5 HP | #2 10 HP | #3 20 HP | #4 40 HP | Total HP | Switched Comps. |
| 0 | OFF | OFF | OFF | OFF | 0 | — |
| 1 | ON | OFF | OFF | OFF | 5 | 1 |
| 2 | OFF | ON | OFF | OFF | 10 | 2 |
| 3 | ON | ON | OFF | OFF | 15 | 1 |
| 4 | OFF | OFF | ON | OFF | 20 | 3 |
| 5 | ON | OFF | ON | OFF | 25 | 1 |
| 6 | OFF | ON | ON | OFF | 30 | 2 |
| 7 | ON | ON | ON | OFF | 35 | 1 |
| 8 | OFF | OFF | OFF | ON | 40 | 4 |
| 9 | ON | OFF | OFF | ON | 45 | 1 |
| 10 | OFF | ON | OFF | ON | 50 | 2 |
| 11 | ON | ON | OFF | ON | 55 | 1 |
| 12 | OFF | OFF | ON | ON | 60 | 3 |
| 13 | ON | OFF | ON | ON | 65 | 1 |
| 14 | OFF | ON | ON | ON | 70 | 2 |
| 15 | ON | ON | ON | ON | 75 | 1 |

The number of compressors switched at the same step varies from 1 to 4. Note particularly that at step 4, three of the four compressors are switched, at step 12 three of the four compressors are switched and at step 8 all four of the compressors have their respective energization state switched. Such operation places are excessive stress on the compressors and on the switch contactors.

By contrast to the above, Table 2 demonstrates the selection of these same four compressors in a "shift logic" manner according to the present invention. Again, a compressor changes state of energization is underlined in the increase capacity direction.

TABLE 2

| | SHIFT LOGIC - 4 COMPRESSORS OF UNEQUAL CAPACITY | | | | | |
|---|---|---|---|---|---|---|
| Step | #1 5 HP | #2 10 HP | #3 20 HP | #4 40 HP | Total HP | Switched Comps. |
| 0 | OFF | OFF | OFF | OFF | 0 | — |
| 1 | ON | OFF | OFF | OFF | 5 | 1 |
| 2 | OFF | ON | OFF | OFF | 10 | 2 |
| 3 | OFF | OFF | ON | OFF | 20 | 2 |
| 4 | OFF | OFF | OFF | ON | 40 | 2 |
| 5 | ON | OFF | OFF | ON | 45 | 1 |
| 6 | OFF | ON | OFF | ON | 50 | 2 |
| 7 | OFF | OFF | ON | ON | 60 | 2 |
| 8 | ON | OFF | ON | ON | 65 | 1 |
| 9 | OFF | ON | ON | ON | 70 | 2 |
| 10 | ON | ON | ON | ON | 75 | 1 |

It will be noted from observing the "switched compressor" column that no more than two compressors are switched from being energized to being deenergized or vice versa at any one step. Although not all of the 15 steps are chosen, there is no excessive stress put on the compressor as with a system that selects by its logic operation all of the possible compressors in the system, which necessitates cycling more than two of the compressors at a time.

Although the above description has been with regard unequal capacity compressors wherein each successively number compressor in the example is twice the size as its predecessor, this is not necessary for operation in the above manner. With the compressor capacities known, and in view of the above description, it would be well within the ability of a person of ordinary skill to program logic device 90 for operation in accordance with the above principles. Alternatively, the mere careful selection of compressor sizing for connection into the system as compressor 12, 14, 16 and 18 of FIG. 1 will accomplish the desired operation.

TABLE 3

| | SHIFT LOGIC - 5 COMPRESSORS, WITH TWO OF EQUAL CAPACITY | | | | | | |
|---|---|---|---|---|---|---|---|
| Step | #1 5 HP | #2 5 HP | #3 10 HP | #4 20 HP | #5 40 HP | Total HP | Switched Comps. |
| 0 | OFF | OFF | OFF | OFF | OFF | 0 | — |
| 1 | ON | OFF | OFF | OFF | OFF | 5 | 1 |
| 2 | OFF | OFF | ON | OFF | OFF | 10 | 2 |
| 3 | OFF | ON | ON | OFF | OFF | 15 | 1 |
| 4 | ON | ON | ON | OFF | OFF | 20 | 1 |
| 5 | ON | ON | OFF | ON | OFF | 30 | 2 |
| 6 | ON | OFF | ON | ON | OFF | 35 | 2 |
| 7 | ON | ON | ON | ON | OFF | 40 | 1 |
| 8 | ON | ON | ON | OFF | ON | 60 | 2 |
| 9 | ON | ON | OFF | ON | ON | 70 | 2 |
| 10 | ON | ON | ON | ON | ON | 80 | 1 |

Table 3 illustrates "shift logic" operation of a compressor system wherein two of the compressors are of equal capacity, but there is general inequality of the compressors in the system. In this example, compressors #1 and #2 are each 5 hp in size, compressor #3 is a 10 hp compressor, compressor #4 has a 20 hp capacity, and compressor #5 has a 40 hp capacity. Again, operation is such that no more than two compressors in the system are switched at the same time. However, in addition, the cycling between the two compressors of the same capacity is equalized to reduce the stress therebetween. Note, for example, that the first time a 5 hp compressor is selected for being switched "ON", compressor #1 is chosen (step 1). The next time a 5 hp compressors is selected for being turned "ON" compressor #2 is selected (step 3). In the entire sequence of steps, it should be further noted that compressors #1 and #2 are switched from one energization state to the other the same number of times.

It may be noted that not all of the possible steps available are chosen; however, as with the table 2 example, no more than two compressors are switched simultaneously. Consequently, the "shift logic" procedure represents the best compromise between precise capacity control and frequency of compressor cycling.

A system involving only four or five compressors has been discussed above. It will be understood that the principles discussed have application to much larger systems. The logic shift schemes selects compressor operation so as to minimize the number of compressors cycling on/off substantially simultaneously and to even wear between or among compressors of the same capacity when there are such included in the group of compressors commonly piped or connected together.

While a particular embodiment of the invention has been shown and described, it will be understood that the invention is not limited thereto, since many modifications may be made and will become apparent to those skilled in the art.

What is claimed is:

1. In combination with apparatus for matching the capacity of a cooling system to a cooling load, comprising a number of commonly piped compressors, at least some of which are not of equal capacity, controllably energized and deenergized by a plurality of actuation means and having a common suction pressure load, each said compressor selectably energized and deenergized independently of the energization state of any other of said compressors to enable more than one said compressor to be selected at a time for change in state energization, and where each combination of energized and deenergized compressors defines a capacity stage;

measurement means for generating an increase capacity signal when said suction pressure exceeds a first preselected value and a decrease capacity signal when said suction pressure falls below a second predetermined value; and selection means for selecting at least one said compressor to be energized or deenergized in response to and at a delayed time following said increase capacity signal or a decrease capacity signal so as to match capacity to the cooling load, the improvement in said selection means comprising a logic means for selecting no more than two of said compressors at a time for change in state energization, said selection means minimizing cycling of said compressors when matching capacity to the cooling load by skipping over those capacity stages which would require more than two of said compressors to change energization states when increasing or decreasing the capacity of the cooling system.

2. Apparatus in accordance with claim 1, wherein no more than one compressor is turned on and no more than one compressor is turned off at a time.

3. Apparatus in accordance with claim 1, and including time delay means connected to said measurement means and to said selection means for ensuring a time period of predetermined minimum duration between successive change-in-state energization occurrences.

4. Apparatus in accordance with claim 3, wherein said time delay means has a first time period of predetermined minimum duration for an increase change-in-state energization occurrence and a second time period of predetermined minimum duration for a decrease change-in-state energization occurrence.

5. In combination with apparatus for matching the capacity of a cooling system to a cooling load, comprising a number of commonly piped compressors, at least two of which are of equal capacity, controllably energized and deenergized by a plurality of actuation means and having a common suction pressure load, each said compressor selectably energized and deenergized independently of the energization state of any other of said compressors to enable more than one said compressor to be selected at a time for change in state energization, and where each combination of energized compressors defines a capacity stage;

measurement means for generating an increase capacity signal when said suction pressure exceeds a first preselected value and a decrease capacity signal when said suction pressure falls below a second predetermined value; and selection means for selecting at least one said compressor to be energized or deenergized in response to and at a delayed time following said increase capacity signal or a decrease capacity signal so as to match capacity to the cooling load, the improvement in said selection means comprising, a logic means for selecting no more than two of said compressors at a time for change in state energization, said selection means minimizing cycling of said compressors when matching capacity to the cooling load by skipping over those capacity stages which would require more than two of said compressors to change energization states when increasing or decreasing the capacity of the cooling system, said logic means alternately selecting between said compressors of equal capacity so to at least approximately equalize the cycling of change in state of energization of one with respect to the other.

6. In combination with apparatus for matching the capacity of a cooling system to a cooling load, comprising a number of commonly piped compressors, at least some of which are not of equal capacity, controllably energized and deenergized by a plurality of actuation means and having a common suction pressure load, each said compressor selectably energized and deenergized independently of the energization state of any other of said compressors to enable more than one said compressor to be selected at a time for change in state energization, and where each combination of energized compressors defines a capacity stage;

measurement means for generating an increase capacity signal when said suction pressure exceeds a first preselected value and a decrease capacity signal when said suction pressure falls below a second predetermined value; and selection means for selecting at least one said compressor to be energized or deenergized in response to and at a delayed time following said increase capacity signal or a decrease capacity signal so as to match capacity to the cooling load, the improvement in said selection means comprising a logic means for selecting no more than two of said compressors at a time for change in state energization, said selection means minimizing cycling of said compressors when matching capacity to the cooling load by not selecting those capacity stages which would require more than two of said compressors to change energization states when increasing or decreasing the capacity of the cooling system, and a time delay means connected to said measurement means and to said selection means for insuring a time period of predetermined minimum duration between successive change-in-state energization occurrances, said measurement means generating a quantitative increase capacity signal and a quantitative decrease capacity signal, and wherein said time period of said delay means is shortened with an increasing value of quantitative increase capacity signal or said quantitative decrease capacity signal.

* * * * *